US012577030B2

(12) United States Patent
Blezard

(10) Patent No.: US 12,577,030 B2
(45) Date of Patent: Mar. 17, 2026

(54) TEMPERATURE CONTROLLED PRODUCT SHIPPER

(71) Applicant: Packaging Technology Group, LLC, Fall River, MA (US)

(72) Inventor: William C. Blezard, Mattapoisett, MA (US)

(73) Assignee: Packaging Technology Group, LLC, Fall River, MA (US)

( * ) Notice: Subject to any disclaimer, the term of this patent is extended or adjusted under 35 U.S.C. 154(b) by 0 days.

(21) Appl. No.: 17/668,569

(22) Filed: Feb. 10, 2022

(65) Prior Publication Data

US 2023/0249896 A1 Aug. 10, 2023

(51) Int. Cl.

| | |
|---|---|
| ***F25D 3/06*** | (2006.01) |
| ***B65D 81/133*** | (2006.01) |
| ***B65D 81/38*** | (2006.01) |

(52) U.S. Cl.

CPC ..... *B65D 81/382* (2013.01); *B65D 81/133* (2013.01); *B65D 2581/051* (2013.01)

(58) Field of Classification Search

CPC ..... F25D 2331/804; F25D 2303/083; F25D 2303/0831; F25D 2303/0845; F25D 2303/0843; F25D 2303/0832; F25D 2331/8014; F25D 3/06; F25D 3/08; F25D 2303/0844; F25D 2303/0822; F25D 2303/08222; F25D 2331/803; A61J 1/165; A61J 2200/44; B65D 81/3832

See application file for complete search history.

(56) References Cited

U.S. PATENT DOCUMENTS

| | | | | | |
|---|---|---|---|---|---|
| 3,807,194 | A * | 4/1974 | Bond | F25D 3/06 | 62/438 |
| 4,474,033 | A * | 10/1984 | Baker | F25D 3/08 | 62/457.2 |
| 4,787,532 | A * | 11/1988 | Borjesson | B65D 81/261 | 220/23.9 |
| 5,435,142 | A * | 7/1995 | Silber | F25D 3/08 | 62/457.2 |
| 6,467,299 | B1 * | 10/2002 | Coetzee | A61J 1/165 | 62/530 |
| 10,618,695 | B2 * | 4/2020 | McCormick | B65D 81/3813 | |
| 12,117,232 | B2 * | 10/2024 | Kagimoto | B65D 81/3825 | |
| 2005/0072181 | A1 * | 4/2005 | Mogil | A45C 11/20 | 62/457.7 |

(Continued)

FOREIGN PATENT DOCUMENTS

| | | | |
|---|---|---|---|
| FR | 2645949 | A1 * | 10/1990 |
| GB | 182960 | A * | 7/1922 |

*Primary Examiner* — Allan D Stevens

(74) *Attorney, Agent, or Firm* — Goodwin Procter LLP

(57) ABSTRACT

A temperature controller shipper for shipping temperature sensitive products. A plurality of individual product boxes contained in an inner mastercase each include a lyophilized product with low thermal mass. The plurality of product boxes each contain a unique PCM thermal dunnage insert occupying the normally empty space within the product box. The PCM insert artificially increases the thermal mass within each product box, and the added thermal mass enables an outer volume of thermal material, e.g. a PCM bladder or bricks, to be minimized to reduce the overall shipper volume and weight.

7 Claims, 6 Drawing Sheets

(56) References Cited

U.S. PATENT DOCUMENTS

| | | | | |
|---|---|---|---|---|
| 2005/0284171 | A1* | 12/2005 | Harl | A47J 41/0044 165/902 |
| 2007/0028642 | A1* | 2/2007 | Glade | A61B 90/98 62/457.2 |
| 2014/0054297 | A1* | 2/2014 | Patstone | F25D 11/003 220/592.01 |
| 2015/0166244 | A1* | 6/2015 | Wood | B31B 50/74 220/592.25 |
| 2017/0082341 | A1* | 3/2017 | Shew | F25D 19/003 |
| 2017/0241702 | A1* | 8/2017 | Klett | F25B 23/006 |
| 2018/0328644 | A1* | 11/2018 | Rizzo | F25D 11/003 |
| 2019/0274925 | A1* | 9/2019 | Vlahinos | B65D 25/108 |
| 2020/0002075 | A1* | 1/2020 | Lee | B65D 81/18 |
| 2020/0408453 | A1* | 12/2020 | Martino | B65D 81/3858 |
| 2021/0024270 | A1* | 1/2021 | Mirzaee Kakhki | B65D 81/3816 |
| 2021/0309442 | A1* | 10/2021 | Kletzel | F25D 3/107 |
| 2021/0396446 | A1* | 12/2021 | Nagar | A01N 1/0263 |
| 2022/0265514 | A1* | 8/2022 | Blezard | A61J 1/16 |
| 2023/0251011 | A1* | 8/2023 | Blezard | B65D 81/3858 62/529 |

* cited by examiner

TEMPERATURE CONTROLLED PRODUCT SHIPPER

BACKGROUND

The instant invention relates to temperature-controlled product shippers, and more particularly to a novel packaging system for use with low thermal mass lyophilized products.

Lyophilization is a water removal process typically used to preserve perishable materials, such as pharmaceuticals, to extend shelf life or make the material more convenient for transport. Lyophilization works by freezing the material, then reducing the pressure and adding heat to allow the frozen water in the material to sublimate.

In the case of pharmaceuticals, lyophilization is used primarily to preserve and extend the shelf life of the product for shipping. However, most lyophilized pharmaceuticals also require strict temperature control. Lyophilization significantly reduces the mass of the product and accordingly, makes temperature control more difficult and expensive.

SUMMARY OF THE INVENTION

Throughout this specification, the exemplary embodiments refer to product shippers and other materials which are typically maintained at controlled temperatures below ambient temperature, i.e. cold-chain applications. However, while the focus of the exemplary embodiments is on "cold chain" packaging, it is to be understood that the concepts as disclosed herein are equally applicable to product shippers which are to be maintained at controlled temperatures above ambient, even though not specifically discussed herein.

Currently, temperature control is accomplished using phase change materials (PCM's) provided in the form of gel packs or gel bricks that are pre-conditioned to a specific temperature and used to cool the interior volume of a temperature-controlled product shipper. Engineers calculate the product mass and the heat loss of a product shipper design based on a client's desired "target" temperature and then use a mixture of various PCM bricks or packs to achieve the desired temperature stability.

Before use, the PCM bricks are preconditioned to a temperature. For example, in most cold chain applications, there are two temperatures used: −20° C. and +5° C. These PCM packs or bricks are conventionally placed between a thermally insulated liner and an inner box. The inner box may contain either a single product box or a plurality of product boxes which each contain a product.

In some cases, the product boxes contain lyophilized products which have a very low thermal mass. Such lyophilized products can be vaccines or medications which require specific shipping temperatures. When the vaccines or medications have been dehydrated, the vacuum sealed powder material that remains has very little thermal mass which is important to maintain the vaccines or medications at the necessary shipping temperatures. In other words, a fully hydrated liquid vaccine has a larger thermal mass and thus is able to maintain its resting, steady state temperature for a longer period of time. The lyophilized vaccine has a much lower thermal mass and thus has little ability to maintain its temperature. The lyophilized material will quickly change temperature if the ambient environment changes. Accordingly, large volumes of thermal phase change material are required to maintain the lyophilized products at the desired controlled temperatures. In typical shipping systems, the larger volumes of phase change material must surround the outer periphery of the product packages in an attempt to maintain the mass and internal volume of the product boxes and the lyophilized products at the necessary temperatures. The result is that the overall shipping package is much larger in size and volume and ends up weighing a substantial amount.

The novel premise of this disclosure is to artificially increase the thermal mass of the lyophilized product by placing a thermal phase change material (PCM) insert, i.e. "thermal dunnage", directly within the product box, directly surrounding the inner container, in as close proximity to the lyophilized product as possible. The amount of external PCM required to maintain a desired temperature is directly related to the internal mass and volume within the PCM envelope. By increasing the thermal mass within the PCM envelope, i.e. essentially giving the lyophilized product an increased mass, the amount of external PCM can be reduced.

In an exemplary embodiment, the instant shipper can include an outer box containing, among other things, a plurality of product boxes contained in an inner box. The plurality of product boxes may each contain a sealed lyophilized product (typically contained within a glass vial) and a PCM thermal dunnage insert occupying the normally empty space within the product box. The added mass enables an outer volume of thermal material, e.g. a PCM bladder or bricks, to be minimized to reduce the overall shipper volume and weight. The external PCM can be disposed around the inner box and an insulated liner can be disposed between the PCM bricks and the outer box.

In some embodiments, depending on the shipping times and particular products being used, the external PCM material can be significantly reduced or dispensed with entirely. In other embodiments, the desired controlled temperature may potentially be maintained by the PCM insert that is disposed directly within each product box.

Accordingly, among the objects of the instant invention are: the provision of a phase change material (PCM) insert, i.e. "thermal dunnage", directly within the product box, directly surrounding the inner product container, in as close proximity to the lyophilized product as possible; the provision of two separate PCM masses, one internal to the product boxes and one external to a the product box; and the provision of a shipping system which advantageously extends the length of time that the desired temperatures can be maintained without increasing the overall volume of the shipper.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE EXEMPLARY EMBODIMENTS

Figure 1:
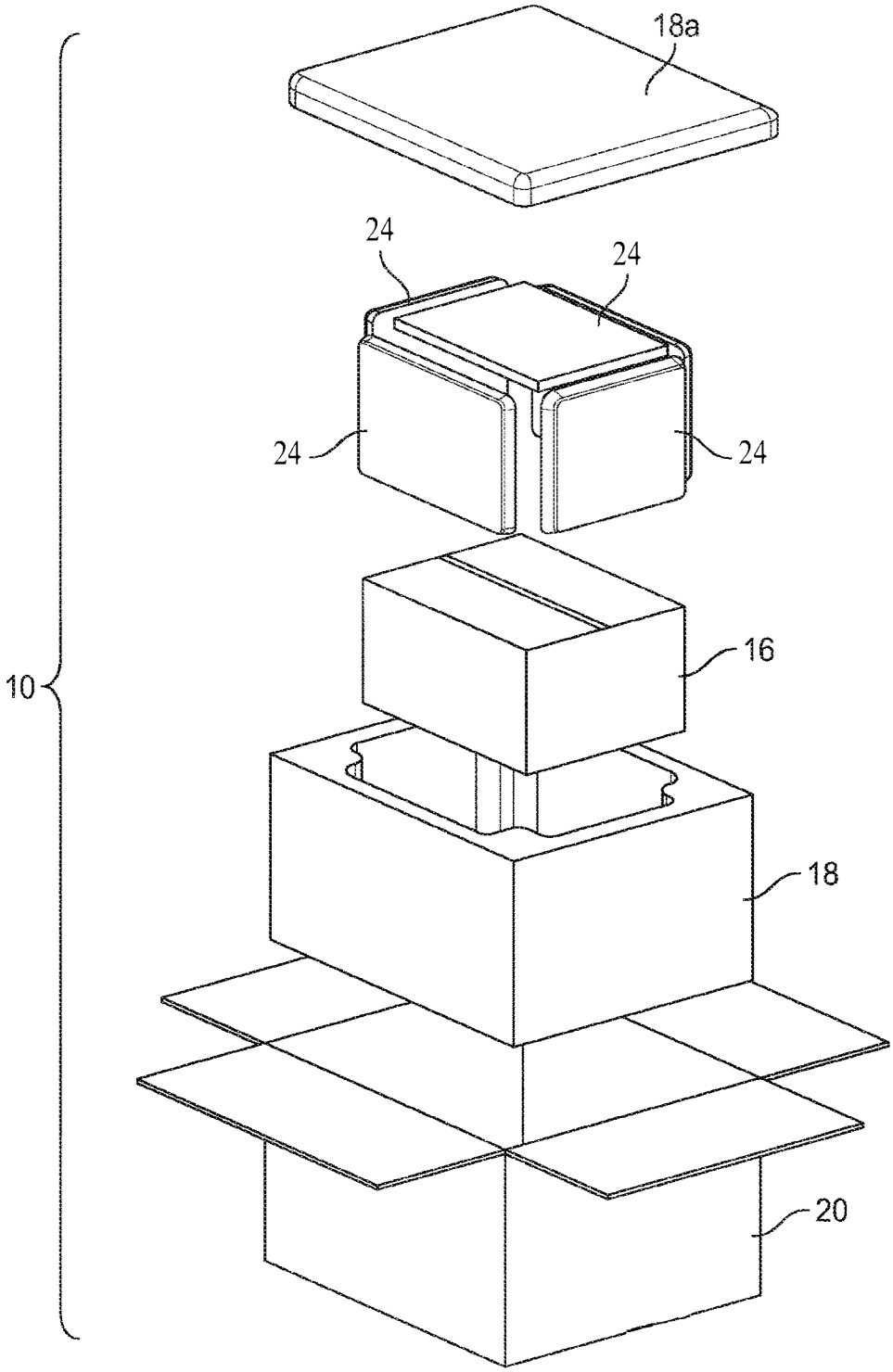
FIG. 1 is an exploded perspective view of a temperature-controlled product shipper in accordance with the present invention.
Figure 2:
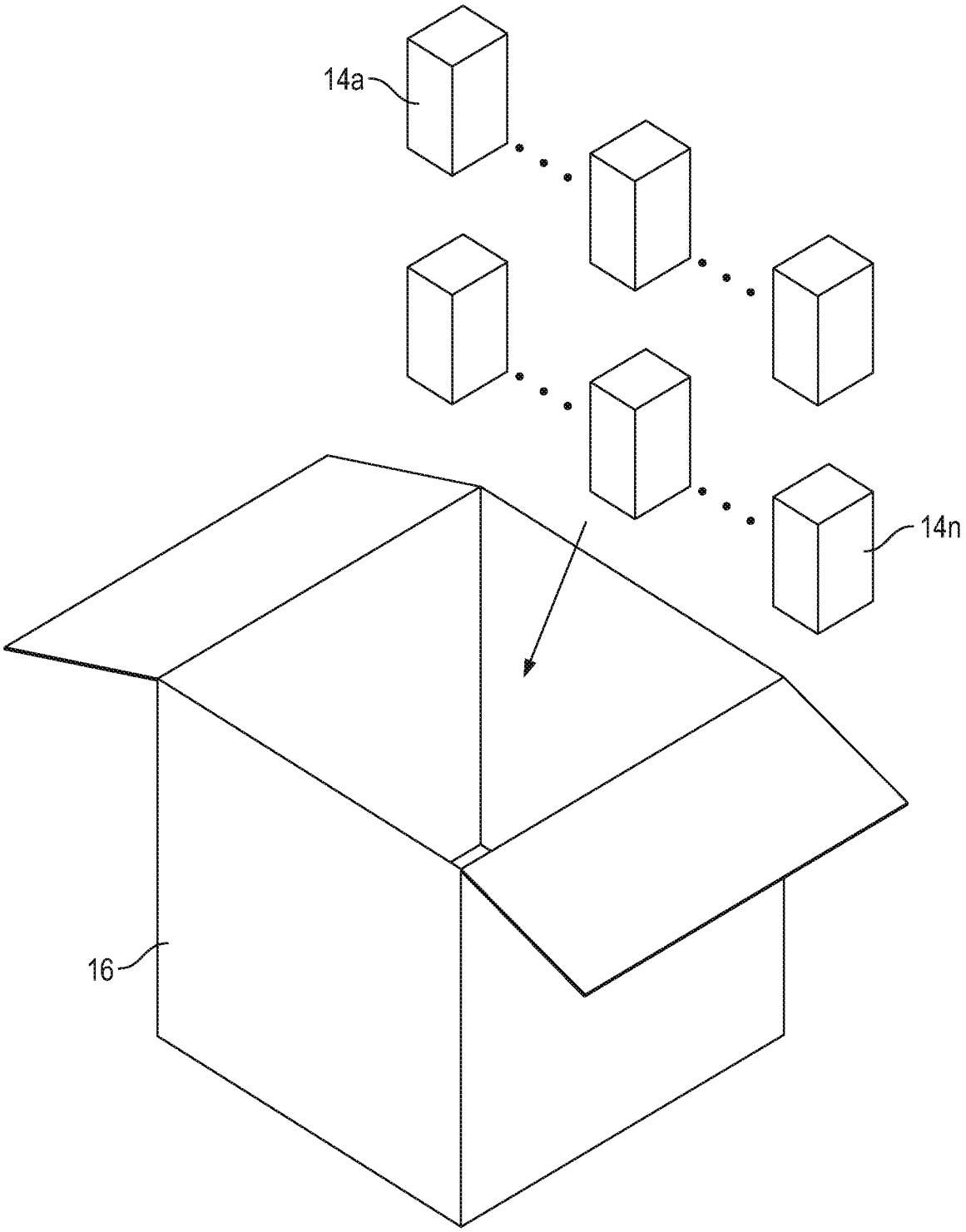
FIG. 2 is an exploded perspective view of a plurality of individual product boxes contained within an inner product box.
Figure 3:
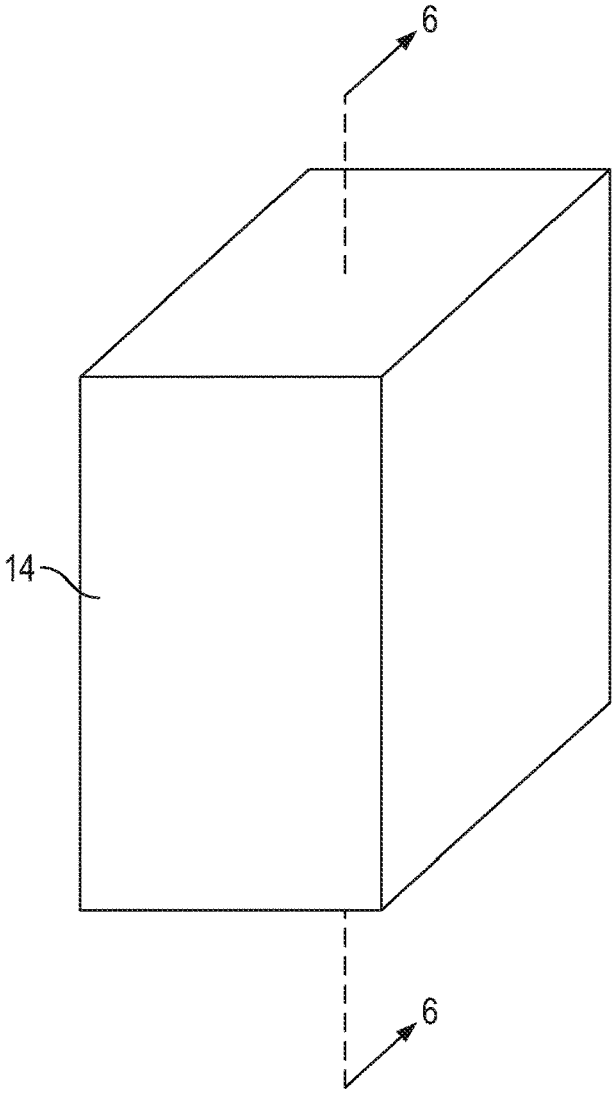
FIG. 3 is a perspective view of an exemplary individual product box containing a lyophilized pharmaceutical product in a glass vial.
Figure 4:
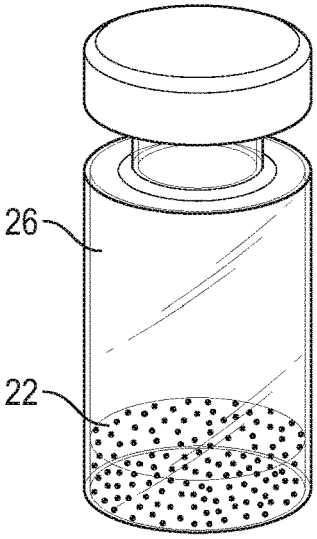
FIG. 4 is a perspective view of an exemplary glass vial.
Figure 5:
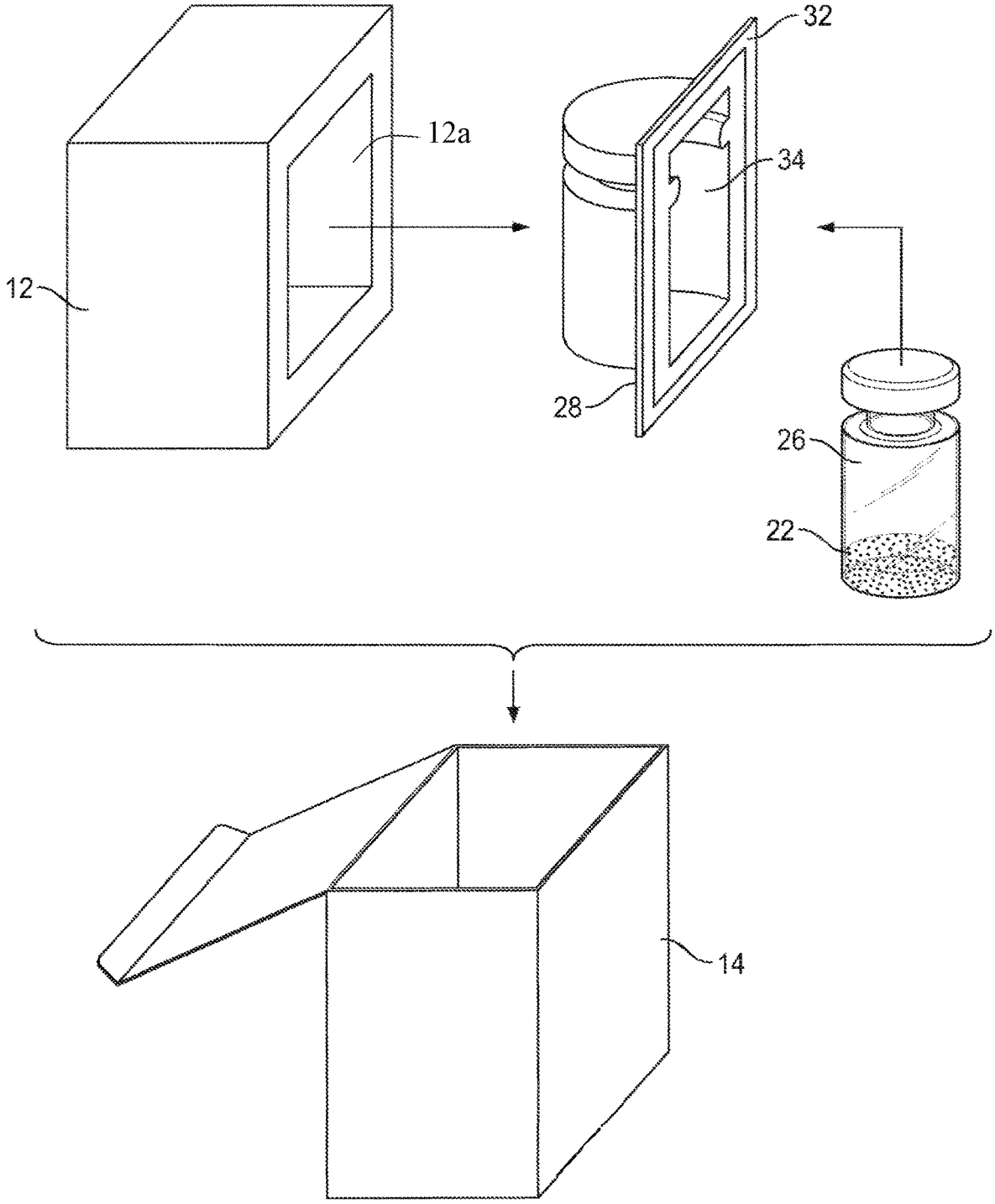
FIG. 5 is an exploded view of the exemplary product box configuration including the novel PCM thermal dunnage insert.
Figure 6:
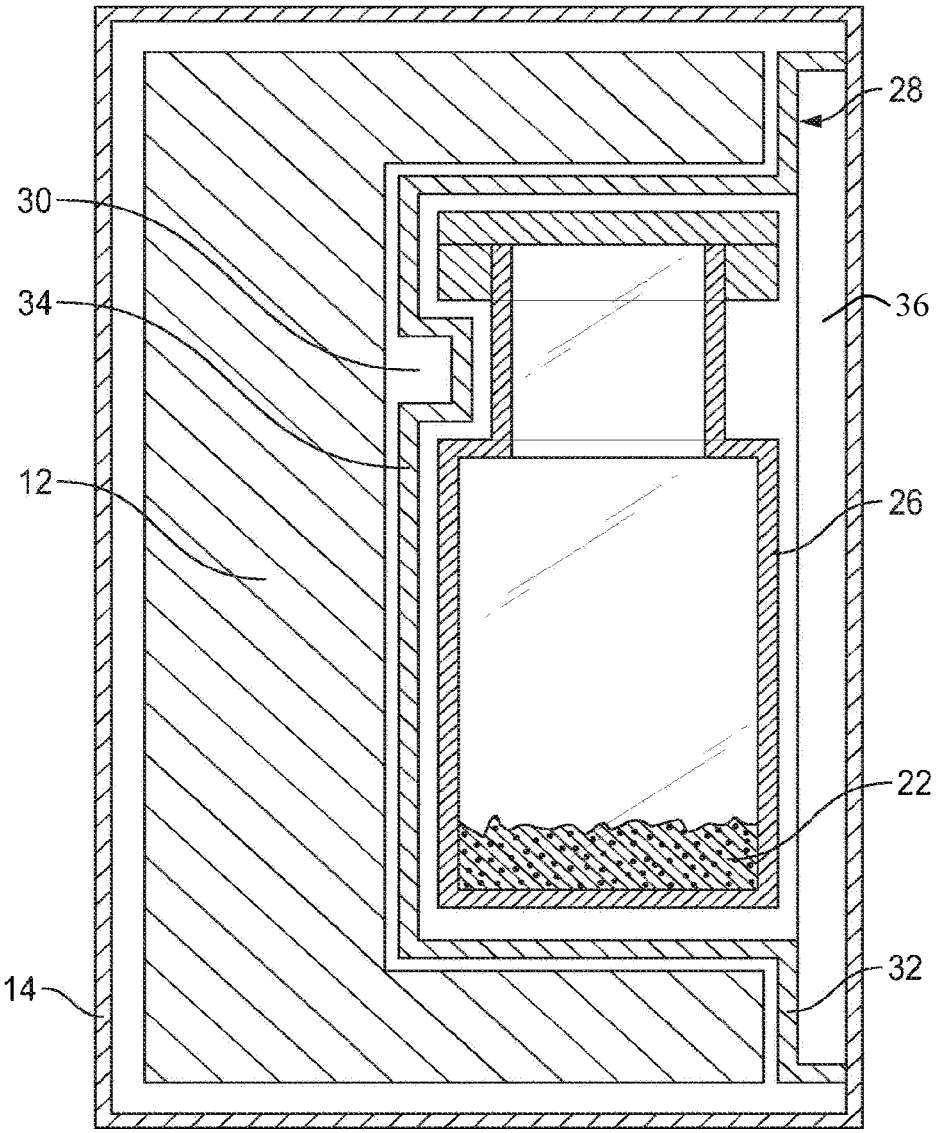
FIG. 6 is a cross-sectional view thereof taken along line 6-6 of FIG. 3.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal.

Referring now to the drawings, a first exemplary embodiment of a temperature-controlled shipper of the instant invention is illustrated and generally indicated 10 at in FIGS. 1-6. As will hereinafter be more fully described, the present invention provides a novel shipping configuration including a phase change material (PCM) insert 12 "thermal dunnage" disposed directly within each of a plurality of product boxes 14, which in turn are contained in an inner box (or mastercase) 16, as it is sometimes called.

The term "phase change material" (PCM) as used within the specification refers to a material having a high heat of fusion which, when melting or solidifying at a certain temperature, is capable of storing and releasing large amounts of energy. Heat is absorbed or released when the material changes from solid to liquid and vice-versa. While the abbreviation PCM is used throughout the application, it will be understood that any form of latent heat transfer material can be used in place of a PCM discussed herein.

The exemplary product shipper 10 can generally include the inner box 16, an insulated liner 18 (which includes a lid 18*a*) and an outer box 20. The inner box 16 is designed to hold the "temperature sensitive product" 22. The inner box 16 is received inside the insulated liner 18, and a plurality of PCM bricks 24 are received into a space defined between the inside surface of the insulated liner 18 and the outside surface of the inner box 16. As noted above, the inner box 16 contains a plurality of individual product boxes 14*a* to 14*n*, each of which may contain a product container 26, which in the context of this disclosure is a vacuum sealed glass vial. The product container 26 in turn contains a small mass of the lyophilized, low thermal mass, temperature sensitive product 22. Such lyophilized products can be vaccines or medications which require specific shipping temperatures. When the vaccines or medications have been dehydrated, the lyophilized powder materials that remain have very little thermal mass to help maintain the vaccines or medications at the necessary shipping temperatures. As can be best appreciated from the cross-section in FIG. 6, the majority of the interior of the product container 26 is empty and sized to accommodate a suitable volume of water for later rehydration of the product 22.

In the present exemplary configurations, the product container 26 is typically suspended or held within the conventional cardboard product box 14 by a plastic blister form 28 to prevent breakage, i.e. the blister form 28 suspends the product container 26 within the interior volume of the cardboard box 14, leaving a significant cavity (or void) 30 within the product box 14. The blister forms 28 may be any variety of shape and size and for the most part they are intended to create the cavity 30 around the product container 26 for protection from direct impacts. The blister form 28 typically includes an outer flange portion 32 which is sized to engage the interior of the product box 14 and a blow molded recess 34 which conforms to and frictionally receives the product container 26.

The novel premise of this disclosure is to artificially increase the thermal mass of the product 22 by placing a thermal phase change material (PCM) insert 12, i.e. "thermal dunnage", directly within the product box 14, directly surrounding the product container (glass vial) 26, in as close proximity to the product 22 as possible. As noted previously, the amount of external PCM (bricks 24) required to maintain a desired temperature is directly related to the internal mass and volume within the PCM envelope, i.e. within an individual product box 14 or inner box 16. In the present configuration, the PCM envelope is the volume within the inner box 16. By increasing the thermal mass within the PCM envelope, i.e. essentially giving the product 22 an increased thermal, the amount of external PCM bricks 24 can be reduced. Reducing the PCM materials 24 surrounding the inner box 16 and thus, reduces the overall volume and weight of the entire shipping system 10.

Each product box 14 has an interior volume containing the temperature-controlled product container 26 therein. The product box 14 is typically larger than the volume of the product container 26 and the product container 26 can be irregularly shaped. In some embodiments, the product container 26 is suspended in the blister form 28. In the illustrated embodiment, the PCM insert 12 can be shaped to conform to the cavity 30 defined between the rear of the blister form 28 and the inner surface of the product box 14. In this case, the insert 12 includes a central cavity 12*a*, which is sized to accommodate the rear projecting recess 34 of the blister form 28. The illustrated cavity 12*a* is rectangular, but could also be formed to identically conform to the rear projecting shape of the recess 34. In addition, and depending on the particular configuration of the blister form 28, an additional PCM insert (not shown) may be disposed in the space 36 between the front of the blister form 28 and the product box 14. In further alternatives, a plurality of individual PCM inserts (not shown) may be disposed in the cavity 30 to occupy all of the empty volume not taken up by the product container 26 and the blister form 28. The empty space between the product container and the inner surface of the product box, i.e. the cavity 30, may be filled at least 80%, 90%, 95%, or 99% (or more) with the PCM insert 12.

The particular type of PCM insert 12 can be chosen for the particular requirements of the product container, the product box and the external shipper.

Figure 7:
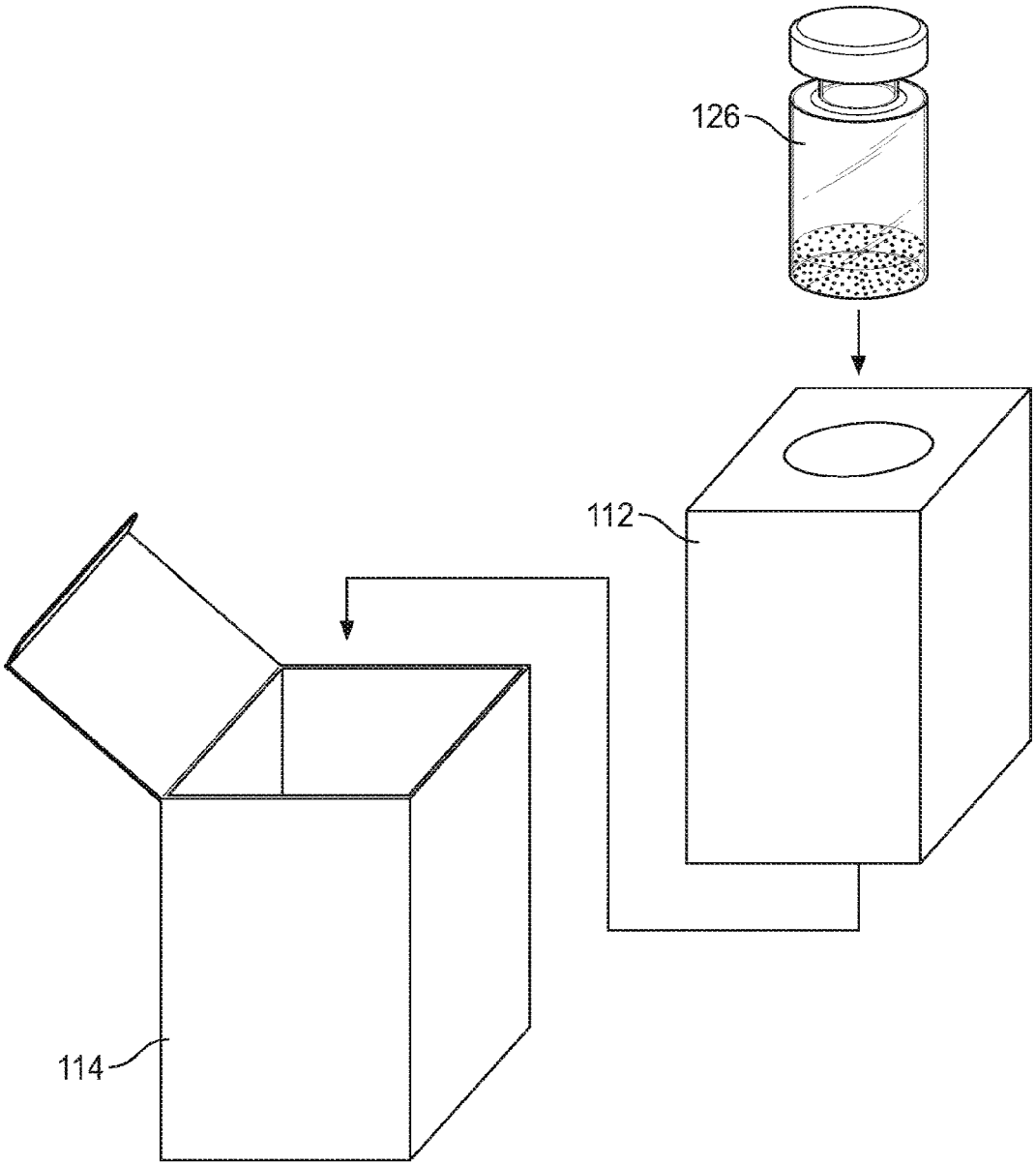
FIG. 7 is an exploded perspective view of an alternative product shipping configuration.

Referring briefly to FIG. 7, another exemplary embodiment is illustrated. In situations where the product container 126 is not suspended by a blister form, the PCM insert 112 can be contoured and shaped to conform to the geometry of the product container 126 and the interior of the product box 114, essentially replacing the plastic blister form with a PCM insert 112 having the dual function of both protection and adding thermal mass.

For the sake of simplicity, only a discussion of a single product box 14 is provided herein. However, it should be appreciated that each of the individual product boxes 14*a* to 14*n* may be and are intended to be configured with a PCM insert 12 disposed therein to increase the overall thermal mass of each individual product box 14.

In some embodiments, the individual product boxes 14 contain the same volume of the same type of product 22 and can contain the same configuration of PCM insert 12.

In alternative embodiments, the product boxes 14 can contain varying amounts of the temperature sensitive product 22, or different types of products, which would require differing configurations of the PCM insert in each product box.

In some embodiments, the PCM inserts 12 disposed in each of the product boxes 14 can be conditioned to the same temperature as the external PCM bricks 24, disposed between the insulated liner 18 and the inner box 16. In an alternative embodiment, the PCM insert 12 and the external PCM bricks 24 can be conditioned at two different temperatures.

While the disclosure herein discusses the use of PCM inserts 12, i.e. thermal dunnage, disposed directly within in product boxes 14 for products 22, the present disclosure can be used with any type of product or product boxes.

It can therefore be seen that the present disclosure provides the following unique concepts: a novel PCM insert configuration for use with lyophilized products in a temperature controlled product shipper; a novel PCM insert that is sized and arranged to be received within individual product boxes in direct proximity to the lyophilized product to increase the overall thermal mass of each respective product box; and a temperature-controlled product shipper which has a smaller volume and a lower shipping weight while maintaining, or increasing, the ability of the shipper to maintain a desired internal shipping temperature.

For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A packaging assembly for a low thermal mass product comprising:

a product box comprising a base and a plurality of walls extending from the base;

a blister form (i) defining a recess and (ii) comprising a flange protruding from a perimeter of the recess, the blister form being disposed within the product box;

a product container suspended in the recess of the blister form, said blister form and an interior surface of a first wall of the product box defining a first cavity therebetween; and a phase change material (PCM) insert disposed within said first cavity, said PCM insert defining a second cavity, a portion of the blister form defining the recess being positioned within the second cavity between the product container and the PCM insert, said PCM insert increasing the thermal mass of material within an interior of said product box, said PCM insert being preconditioned at a predetermined temperature, wherein a first side of the flange engages an interior surface of a second wall of the product box and a second side of the flange engages the PCM insert, the first and second sides being (i) opposite sides of the flange and (ii) substantially parallel to one another.

2. The packaging assembly of claim 1, wherein the PCM insert is sized to fill at least 80% of the first cavity.

3. The packaging assembly of claim 1, wherein the product container is configured to store a lyophilized product.

4. A temperature-controlled shipper for shipping temperature sensitive products having a low thermal mass, said temperature-controlled shipper comprising:

a product box comprising a base and a plurality of walls extending from the base;

a blister form (i) defining a recess and (ii) comprising a flange protruding from a perimeter of the recess, the blister form being disposed within the product box;

a product container suspended in the recess of the blister form, said blister form and an interior surface of a first wall of the product box defining a first cavity therebetween;

a phase change material (PCM) insert disposed within said first cavity, said PCM insert defining a second cavity, a portion of the blister form defining the recess being positioned within the second cavity between the product container and the PCM insert, said PCM insert increasing the thermal mass of material within an interior of said product box, said PCM insert being preconditioned at a predetermined temperature, wherein a first side of the flange engages an interior surface of a second wall of the product box and a second side of the flange engages the PCM insert, the first and second sides being (i) opposite sides of the flange and (ii) substantially parallel to one another;

an outer box;

an insulated liner received within the outer box, said product box being received within said insulated liner; and a plurality of external PCM bricks respectively received within cavities defined between an outer surface of said product box and an inner surface of the insulated liner.

5. The temperature-controlled shipper of claim 4, wherein the product container is configured to store a lyophilized product.

6. The temperature-controlled shipper of claim 4, wherein said PCM insert is preconditioned at a first temperature and the external PCM bricks are preconditioned at a second temperature.

7. The temperature-controlled shipper of claim 4, wherein said PCM insert is sized to fill at least 80% of the first cavity.

* * * * *